United States Patent [19]

Marx

[11] Patent Number: 4,955,729

[45] Date of Patent: Sep. 11, 1990

[54] HEARING AID WHICH CUTS ON/OFF DURING REMOVAL AND ATTACHMENT TO THE USER

[76] Inventor: Günter Marx, G.-Caracciola-Strasse 10, 8035, Gauting, Fed. Rep. of Germany

[21] Appl. No.: 174,689

[22] Filed: Mar. 29, 1988

[30] Foreign Application Priority Data

Mar. 31, 1987 [DE] Fed. Rep. of Germany ... 8704763[U]
May 14, 1987 [DE] Fed. Rep. of Germany ... 3716162[U]
Dec. 16, 1987 [DE] Fed. Rep. of Germany ..... 3742529

[51] Int. Cl.[5] ..... H04R 25/00

[52] U.S. Cl. ..... 381/68; 381/69.2; 381/123; 623/24

[58] Field of Search ..... 381/68, 69.2, 123; 307/117; 338/22 R; 623/24

[56] References Cited

U.S. PATENT DOCUMENTS

| | | | |
|---|---|---|---|
| 2,673,898 | 3/1954 | Reichert | 381/69.2 |
| 2,899,499 | 8/1959 | Eichwald | 381/123 |
| 3,227,836 | 1/1966 | Renwick, Sr. | 381/123 |
| 3,491,203 | 1/1970 | Shabad | 381/68 |
| 3,869,619 | 3/1975 | Camillo | 307/117 |
| 4,278,873 | 7/1981 | Petrides | 307/117 |
| 4,295,088 | 10/1981 | Malchow | 307/310 |
| 4,467,145 | 8/1984 | Borstel | 381/123 |
| 4,504,922 | 3/1985 | Johnson et al. | 307/117 |
| 4,800,292 | 1/1989 | Gillett | 307/117 |

FOREIGN PATENT DOCUMENTS

| | | | |
|---|---|---|---|
| 3109049 | 9/1982 | Fed. Rep. of Germany | 381/68 |
| 54-39121 | 3/1979 | Japan | 381/123 |
| 55-165096 | 12/1980 | Japan | 381/68 |
| 878309 | 9/1961 | United Kingdom | 381/69.2 |

*Primary Examiner*—Jin F. NG
*Assistant Examiner*—Danita R. Byrd
*Attorney, Agent, or Firm*—Henry M. Feiereisen

[57] ABSTRACT

A hearing aid includes an electronic amplifier, an electric power source and a switch for automatically breaking or making the connection between the amplifier and the power source depending on whether the hearing aid is in use or out of use. The switch is provided in such a manner so as to be responsive to switching criterion defined by a change of state such as change in temperature, moisture etc. The switch is disposed at a wall surface which is subjected to the change of state.

24 Claims, 2 Drawing Sheets

HEARING AID WHICH CUTS ON/OFF DURING REMOVAL AND ATTACHMENT TO THE USER

BACKGROUND OF THE INVENTION

The present invention refers to a hearing aid, and in particular to a hearing aid with a switch for controlling the connection to a power source.

Hearing aids of this kind generally include an electronic amplifier connected to the power source e.g. a battery which supplies the necessary energy for allowing the amplifier to boost the incoming sound pressure to an higher outgoing sound pressure. The amplifier includes the earphone providing the signal at the sound outlet port which is in connection with the ear.

In order to prevent a useless current drain and to save energy when the hearing aid is not in use, a manually actuable switch is provided by which the connection between the amplifier and the power source may be interrupted. Such a hearing aid has the drawback that the user may forget to actuate the switch after use so that the battery may run empty especially when leaving the hearing aid in on-position overnight. The same is true when the hearing aid after being turned off is dropped and hits an object which may accidently change the switch to the on-position thereby draining the battery and thus rendering the hearing aid inoperative.

The U.S. Pat. No. 3,227,836 describes an eyeglass frame with an integrated hearing aid which includes a switch in form of a spring-loaded plunger projecting from the side piece of the eyeglass and provided for making or breaking a connection between suitable contacts and thus between the power source and the amplifier. When wearing the eyeglass, the plunger is slid forwardly to close the contacts. When removing the eyeglass, the plunger is returned by the action of the spring so as to open the contacts.

A hearing aid of this kind has the drawback that the spring-loaded plunger exerts during wearing of the eyeglass a force which may result in painful pressure marks on the skin of the user and may lead to changes of the skin. Considering that hearing aids are worn for a prolonged period, the use of such an eyeglass frame is uncomfortable for the stated reasons.

The DE-OS 31 09 049 discloses a hearing aid which includes a manually actuated on-off switch and in addition a magnetic switch responsive to the magnetic field of a telephone receiver or a headset. This magnetic switch acts, however, only in response to magnetic variations when guiding the telephone receiver or headset to the ear but does not control functions of the hearing aid.

SUMMARY OF THE INVENTION

It is thus an object of the present invention to provide an improved hearing aid obviating the afore-stated drawbacks.

This object and others which will become apparent hereinafter are attained in accordance with the present invention by providing a switch which automatically breaks or makes the connection between the amplifier and the power source when removing or attaching the hearing aid and is responsive to a change of state during removal or attachment of the hearing aid whereby the switch is arranged at a location which is subjected to the change of state.

According to the teachings of the present invention, the automatic switching function is obtained by using as switching criterion a change of state which occurs when removing or attaching the hearing aid. Utilizing such a change of state which may be of physical nature or physico-chemical nature is more suitable as switching criterion for switches than known spring-loaded actuating elements as no repercussion are encountered from the switch to the user of the hearing aid.

According to one embodiment of the present invention, the switch is a temperature-sensitive switch which is responsive to temperature changes occurring when contacting the skin of the user or when being located in the auditory meatus. Other suitable switching criteria may include the change of moisture, light, posture, oxygen partial pressure, motion. Further, it may be possible to provide a switch which is responsive to a feedback signal generated through acoustic feedback between microphone and earphone after removing the hearing aid. The feedback signal may be a sound signal which is emitted by the earphone and is above a predetermined sound level. The respective switch includes a control element which is responsive to the increased sound level. Preferably, the control element is a sound pressure converter which converts the sound pressure e.g. in a voltage signal by which the hearing aid is turned off.

According to a variant of the invention, the control element may be modified so as to be responsive to a certain frequency or frequency range of a whistle tone generated by the acoustic feedback.

The hearing aids in accordance with the invention may be designed as pocket hearing aids in which the amplifier and the power source as well as other operating elements are contained in a box which is carried in the pocket. An ear insert is connected via electric lines with the box and has a wall in which the switch according to the invention is arranged. The hearing aid may, however, also be designed as a single ear insert which contains all electronic components in miniature form and includes the switch at an appropriate location of its outer shell. In a hearing aid which includes a housing carried behind the ear, or also in hearing aid glasses, the switch according to the invention may be arranged at the housing wall which is in contact with the head of the user and thus is subjected to the change of state.

Preferably, the switch is adjustable to various intensities of the change of state. For example, in connection with a switch in form of a temperature-sensitive switch, the response temperature may be altered by using a suitable transistor circuit or by modifying the distance of the contact from the bimetal vane so that various skin temperatures can be taken into account.

BRIEF DESCRIPTION OF THE DRAWING

The above and other objects, features and advantages of the present invention will now be described in more detail with reference to the accompanying drawing in which.

DESCRIPTION OF PREFERRED EMBODIMENTS

Figure 1:
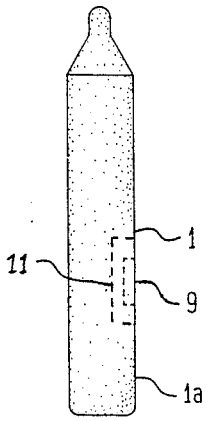
FIG. 1 is a rear elevational view of one embodiment of a hearing aid in accordance with the present invention on an enlarged scale.
Figure 2:
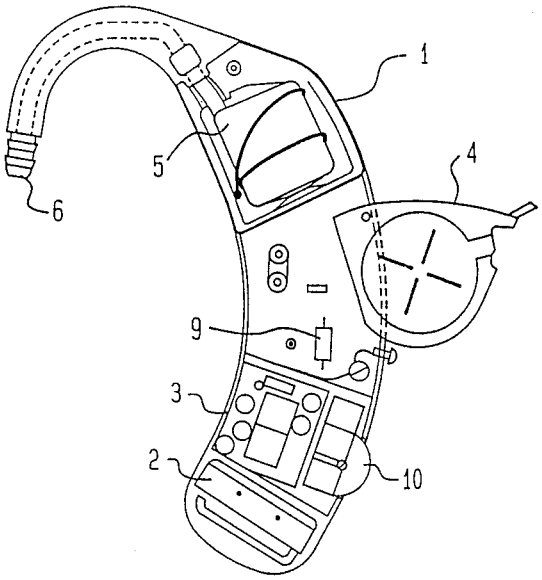
FIG. 2 is a side view of the hearing aid of FIG. 1 with the housing front portion removed to illustrate the interior thereof.

Referring now the drawing, and in particular to FIGS. 1 and 2, there is illustrated a rear elevational view and a side view of a hearing aid in accordance with the present invention. The hearing aid which is of a type to be attached behind the ear of a user includes a housing 1 of suitable plastic material and has a sound inlet port at its lower end. Arranged at the sound inlet port is a microphone 2 which is electrically connected to an amplifier 3 such as e.g. a resistance-capacitance coupled (RC) amplifier which will be described in more detail furtherbelow with reference to the connection diagram illustrated in FIG. 3. Adjacent to the amplifier 3 is a swingable case 4 which accommodates an electric power source (not shown) such as e.g. a suitable battery supplying the amplifier 3 with the required electric power. FIG. 2 shows the case 4 in an outwardly pivoted position. An receiver 5 is arranged at the upper section of the housing 1 and is in operative connection with a sound outlet port 6. The amplifier 3 is further operatively connected to a volume control with a rotatable knob 10 projecting outward of the housing 1 to permit manual adjustment of the volume.

Figure 3:
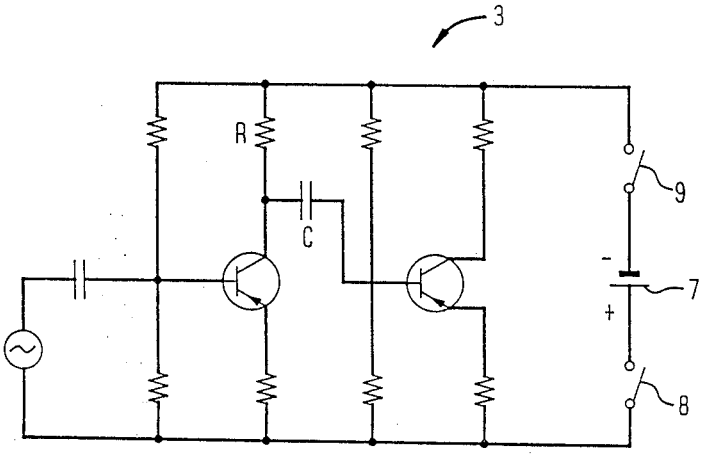
FIG. 3 is a schematic diagram of a hearing aid amplifier according to the present invention.

Turning now especially to FIG. 3, there is illustrated a connection diagram of a RC-amplifier in accordance with the invention. The RC-amplifier 3 which includes suitably arranged resistors R and capacitors C and is supplied with current by the power source 7 is provided with a manually actuatable switch 8 and a further switch 9 arranged in series with the switch 8.

According to a first embodiment of a hearing aid in accordance with the invention, the switch 9 may be a temperature-sensitive switch 9 of any suitable type such as a bimetal switch, electronic transistor circuits like e.g. thermistors (so-called positive temperature coefficient (PTC) resistors or negative temperature coefficient (NTC) resistors), or any other suitable electronic element with an electric resistance dependent on the temperature. NTC-resistors are suitable as temperature-sensitive switches within the scope of the invention because they have a high resistance at lower temperatures so that the current flow between the power source 7 and the amplifier 3 is reduced to zero and have a low resistance at higher temperatures for allowing a current flow. Furthermore, the temperature-sensitive switch 9 may be a magnetic switch with the contacts kept open by permanent magnets which have a Curie point set to a predetermined value so that the magnets are demagnetized at a certain temperature to break the connection between e.g. spring-loaded contacts.

The temperature range at which the switch 9 is responsive is between 30° to 35° C. and is given by the body temperature of a human body. The temperature range may be adjustable by suitable control mechanisms which for ease of illustration are not shown in detail.

As is illustrated in FIG. 1, the temperature-sensitive switch 9 is arranged at the side wall 1*a* of the housing 1 so as to be in intimate contact with the thus facing head of the user when attaching the hearing aid behind the external ear. Suitably, the switch 9 is surrounded by an area of the side wall 1*a* in which a thin metal plate 11 is embedded within the wall of the plastic housing 1 as indicated by broken lines and is in close heat-conducting connection with the switch 9. Thus, shortly after attaching the hearing aid, the switch 9 reaches the response temperature in view of the heat flux from the user's skin through the metal plate 11 and to the switch 9 so that the hearing aid is rapidly switched on provided the switch 8 is actuated as well.

When the user removes the hearing aid without actuating the switch 8, the heat supply from the skin to the switch 9 is interrupted so that the temperature of the switch 9 drops and falls below the set response temperature at which point the power source 7 is disconnected from the amplifier 3 thereby preventing an undesired drain of the power source 7.

Since the response temperature of the switch 9 is reached in a very short period, it is certainly conceivable to omit the switch 8 entirely, and thus control the on-off mechanism of the hearing aid solely by the switch 9.

In the above-mentioned embodiment of a hearing aid according to the invention, the switch 9 is a temperature-sensitive switch which breaks the connection between the power source 4 and the amplifier 3 when the temperature drops below a preset temperature e.g. 30°-35° C. which temperature range is given by the body temperature of a human body.

According to a modification of a hearing aid of this kind, the hearing aid includes a temperature-sensitive switch which is responsive to a temperature range between a lower limit of 30°-35° C. and an upper limit of about 41° C. i.e. at an upper temperature which usually does not occur in the human body. A modification of the switch 9 in this manner allows the use of the hearing aid also in warmer or tropical areas in which the temperature can easily be or exceed temperatures of 30°-35° C. rendering the previously described embodiment of the switch ineffective to break the connection between the amplifier 3 and the power source 7.

Figure 4:
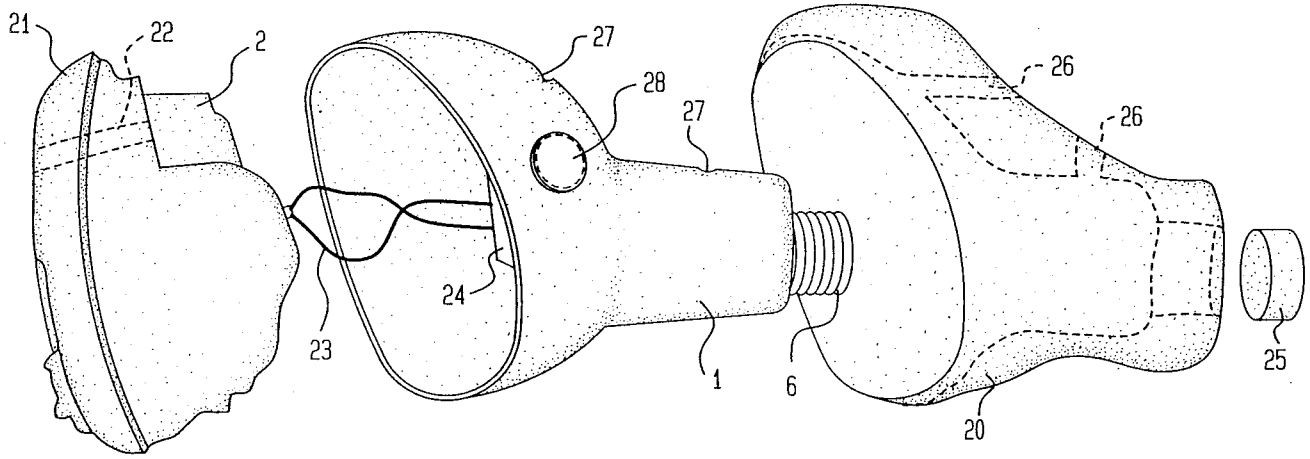
FIG. 4 is an exploded view of an ear insert incorporating a hearing aid according to the invention.

The hearing aid according to the invention can further be modified by combining the temperature-sensitive switch in suitable manner with an additional optical indicator such as for example an optical indicator 28 as shown schematically in FIG. 4 which is responsive to a temperature within the range between the temperature limits of 30°-35° C. and 41° C. so that the hearing aid can be switched off when the outside temperature is between these upper and lower temperature ranges. When using the hearing aid at such outside temperatures, the optical indicator delivers an optical signal so as to remind the user to turn off the hearing aid when removing the latter. In this case, the hearing aid is suitably provided with the switch 8 to allow manual breaking of the connection between the amplifier 3 and the power source 7. The temperature-dependent optical indicator may, certainly, be modified so as to respond to other temperature ranges or to only one limit temperature.

Suitable temperature-dependent optical indicators are e.g. reversible color indicators which change their color in dependence on the temperature. Advantageously, in the range between the lower and upper temperature limits the color should change to red to notify the user that the hearing aid should be manually turned off because the outside temperature is within the temperature range at which no automatic disconnection can occur.

Reversible temperature-dependent color indicators are e.g. known temperature indicators with microencapsulated liquid crystals which display different colors at varying temperatures. Such temperature indicators are available in form of very thin film-like strips printed with microencapsulated liquid crystals and thus demand very little space.

According to a second embodiment of the present invention, the switch 9 of the hearing aid responds to a feedback signal in form of an acoustic feedback generated after removal of the hearing aid from the ear between the microphone 2 and the earphone 5. It is a known fact that the adjoining arrangement of the microphone and the earphone especially in those hearing aids with one-piece housing easily creates acoustic feedbacks which are generated by airborne sound propagating from the earphone to the microphone or by vibrations transmitted from the housing to the microphone. The acoustic feedback may cause in the range of certain frequencies considerable linear distortions or amplitude increases or may lead to a whistling of the hearing aid when the entire circuit is not suitably attenuated. Such acoustic feedbacks are considered undesired and are prevented in known hearing aids by elastically supporting the earphone and the microphone so as to minimize the vibrations while airborne sound bridges are avoided or minimized by using microphones and earphones with specific directional characteristics.

The present invention now utilizes specifically those feedback effects as switching criteria for switching off the hearing aid, and thus avoids the use of microphones and/or earphones with narrow directional characteristics as previously described.

According to one variant of the present invention, the feedback signal is an acoustic signal above a predetermined sound level. The switch 9 of the hearing aid is defined by a control element which responds to the increased sound level created by the feedback and converts the sound pressure into a voltage signal for switching off the hearing aid.

Another variant of the present invention utilizes the whistling created by the feedback. The switch 9 is now a control element which is responsive to frequencies of the whistle tone to switch off the hearing aid.

It is certainly conceivable to combine both variants and thus to provide a control element which responds to a certain frequency and to an increased sound level so that the hearing aid is automatically switched off at a whistle tone above a certain sound level. Such a combination is especially advantageous when placing the hearing aid in a location where the microphone might receive various sounds in the stated frequency range e.g. music sounds.

According to yet another variant of a hearing aid of this type, the feedback signal is a voltage signal which is generated in the amplifier 3 by an input sound pressure increased through the acoustic feedback. The teachings of the present invention are based on the fact that at the beginning of the feedback, the amplitudes at the amplifier output increase before the mentioned distortions and/or whistling tone are created. The increased voltage signal at the amplifier output is then directly usable for switching off the hearing aid without using a control element responsive to a sound level and/or certain frequency.

The generation of a feedback signal in accordance with the previously described variants of a second embodiment of the invention, and in particular the creation of an airborne sound bridge will now be described with reference to FIG. 4 which shows an exploded partly broken view of an ear insert containing the hearing aid and insertable within the auditory meatus. The ear insert as shown in FIG. 4 is made by way of example only and thus the features of the present invention should not be limited to a hearing aid of this type. Therefore, same reference numerals as in FIG. 2 have been used in the nonlimiting example of FIG. 4 for corresponding parts.

As can be seen from FIG. 4, the ear insert includes an outer shell 20 the shape of which is adaptable to the auditory meatus of a user. Insertable within the outer shell 20 is the housing 1 of the hearing aid, and a face plate or cover plate 21 closes the outer shell 20 toward the outside. The microphone 2 is accommodated in vicinity of the face plate 21 and is in communication with the outside via a passage 22. The amplifier 3 (not shown in FIG. 4) cooperates with the microphone 2 and is operatively connected via respective connecting wires 23 to a receiver 24. At the inner end facing the auditory meatus, the ear insert is closed by a screw nut 25 which is threadably engagable with a threaded connection 6 defining the sound outlet port. Although not shown in detail, the switch 9 is arranged within the outer shell 20 at a suitable location thereof so as to bear against the inner wall surface of the auditory meatus when the ear insert is placed within the auditory meatus.

As shown in FIG. 4, the airborne sound bridge is defined by two spaced bores 26 in the outer shell 20 which are in alignment with bores 27 in the housing 1. During use of the hearing aid, i.e. when placing the ear insert into the auditory meatus, the airborne sound bridge is interrupted because the ear insert bears tightly against the wall surface of the auditory meatus and thus closes the bores 26, 27. When removing the ear insert, however, the bores 26, 27 are exposed so as to generate an airborne sound bridge which automatically causes the responding control element 9 to switch off the hearing aid in a manner as above described.

Instead of a switch responsive to an acoustic feedback signal, such an ear insert may certainly also be equipped with a switch in form of a temperature-sensitive switch which is described with reference to FIGS. 1 and 2 illustrating a hearing aid of the type carried behind the ear. As will be readily recognized, the switch 9 is then arranged in the outer shell 20 at a suitable location thereof so as to bear against the inner wall surface of the auditory meatus when the ear insert is placed therein. Likewise the provision of a switch using the acoustic feedback as switching criterion as described in connection with the second embodiment of the invention is certainly feasible also in a hearing aid as shown in FIG. 2.

According to a third embodiment of a hearing aid in accordance with the invention, the switch 9 may be provided in form of a light-sensitive control element which is attached to an ear insert according to FIG. 4 at an area extending in the interior of the auditory meatus during use of the hearing aid. The ear insert completely seals off the auditory meatus so that no light can penetrate and the switch is located in complete darkness. When removing the hearing aid, however, the light-sensitive control element will react to incident light at which point the hearing aid is automatically turned off. Evidently, the control element is adjusted in such manner that it allows a connection between amplifier and power source only at complete darkness i.e. when the ear insert is placed inside the auditory meatus and thus is prevented from turning off the hearing aid when used at night hours during which complete darkness does not occur.

According to a fourth embodiment of a hearing aid in accordance with the invention, the switch 9 is of a type reacting to variations in the moisture. Human skin transpires continuously so that an increase of moisture relative to the surrounding air is registered during contact with the skin. This increase in moisture can be utilized through electrolytic resistance decrease or through very small electric control currents flowing on the skin surface.

According to a fifth embodiment of a hearing aid in accordance with the invention, the switch 9 may be a liquid switch such as a mercury switch which responds to a change in position of the hearing aid. Thus, the liquid switch 9 closes the circuit between the power source 7 and the amplifier 3 when the hearing aid is inserted in the ear and the head is held in normal position. The hearing aid may include an especially designed surface for placing the hearing aid when not in use to guarantee a breaking of the circuit. It should be noted that certainly switches other than the described liquid switches may be used, e.g. a switch with movable contact which is loaded during use so as to close the circuit while being retracted when removing the hearing aid. In order to avoid a disconnection of the contact upon sudden head motion, the switch may be equipped with an electronic circuit which maintains the connection for a short period like one or several seconds after separation of the contacts.

According to a fifth embodiment of a hearing aid in accordance with the present invention, the switch 9 includes a motion indicator which switches off the hearing aid when no motion is registered over a predetermined period e.g. 20 seconds. For that purpose, the motion indicator is suitably combined with a delay element. During use, the hearing aid is usually in motion as a user would rarely keep the head stationary over a period of more than a few seconds so that the hearing aid will remain in on-position during use thereof. Only when putting away the hearing aid, the motion indicator after elapse of the predetermined delay time turns off the hearing aid.

Preferably, the hearing aid is additionally equipped with a manually actuatable switch such as switch 8 which should be used to turn off the hearing aid when for example putting away the hearing aid in a moving car because the required low threshold sensitivity of such motion indicators will otherwise switch the hearing aid in on-position although such may not be desired.

According to a sixth embodiment of the hearing aid in accordance with the invention, the switch 9 may be a switch responding to an oxygen partial pressure and thus breaks the connection between the amplifier and the power source at the oxygen partial pressure of the atmosphere. Since the the external auditory meatus has a lower oxygen partial pressure when closed by the ear insert of the hearing aid than the partial pressure of oxygen of the atmosphere, the increase of the oxygen partial pressure can be utilized for automatically switching off the hearing aid when being removed from the ear.

Although the various embodiments of the switch 9 are described for primarily switching off the hearing aid at certain changes of state, it is certainly possible to use the switch 9 also for turning on the hearing aid when inserting the latter into the ear although some embodiments may be less suitable because they may require additional measures to connect the circuit, or the change of state during insertion of the hearing aid progresses slower than in the opposite case. For example, in case of using the acoustic feedback, the hearing aid once turned off cannot be switched on simply by the lack of a feedback signal. With regard to the application of the partial pressure of oxygen as switching criterion, it should be noted that the partial pressure increases suddenly when removing the hearing aid while in the other case is reduced gradually when inserting the hearing aid. Therefore, it is suitable to provide the circuit closing of the hearing aid by means of other switching criteria or preferably by providing a manually actuatable switch which is evidently actuated by the user automatically when attaching the hearing aid.

It may be suitable to equip the hearing aid in addition to the automatic switch 9 with a manually actuatable switch 8 for turning on or off the hearing aid. This is especially appropriate in the case in which the switch 9 is a temperature-sensitive switch with optical indicator. In this case, the optical indicator notifies the user that the hearing aid cannot be automatically switched off because the outside temperature corresponds to the response temperature of the switch. Thus, the user has the possibility to turn off the hearing aid by means of the manually actuatable switch 8.

It is certainly also conceivable to use not only one of the mentioned changes of state as switching criterion for turning on or off the hearing aid but also to apply the rate of change by which the respective state is changed i.e. to use the gradient of the change of state in dependence on the time. For example when taking the temperature change as switching criterion, the switch may be combined with a suitable measuring device for detecting e.g. a temperature change from 35° C. to 20° C. within a certain time period e.g. three seconds or a temperature gradient of 2° C./sec in both directions i.e. decreasing and increasing. The use of the temperature gradient in dependence on the time as switching criterion has the advantage that the hearing aid is not automatically switched off when the temperature of the hearing aid slowly decreases to a lower level e.g. when the user goes outside but which level is still above the absolute threshold value at which a switching off is attained.

The use of the gradient of the change of state is also suitable for application in connection with the feedback signal as switching criterion in which the increased sound level as emitted by the earphone is used to switch off the hearing aid by means of a sound pressure converter via its voltage signal. In general, the sound pressure increases rapidly when the feedback is created so that the amplitude change per unit of time can be used as switching criterion to avoid an increased noise level already at the start when removing the hearing aid.

The use of a sound pressure converter which turns off the hearing aid at increased amplitude by responding to the sound pressure or to its gradient is also of advantage in those circumstances in which the hearing aid is switched off although being placed for use in the external auditory meatus because of a considerable external sound pressure e.g. an explosion or sudden increase of the noise level. Thus, the user is not subjected to sounds above the threshold of pain.

While the invention has been illustrated and described as embodied in a Hearing Aid, it is not intended to be limited to the details shown since various modifications and structural changes may be made without departing in any way from the spirit of the present invention.

Suitably, the switch 9 may include a biosensor which generates an electrical signal in correspondence with the switching criterion when the hearing aid is inserted in the auditory meatus of the user. Such a biosensor has been referred to e.g. in "Transaction of American Society for Artificial Internal Organs, 1987, pages 834–837.

What is claimed as new and desired to be protected by Letters Patent is set forth in the appended claims:

I claim:

1. A hearing aid; comprising:

amplifying means including an amplifier for boosting an incoming signal;

a power source operatively electrically connected to said amplifier; and switching means for automatically controlling the electrical connection between said amplifier and said power source by automatically providing the electrical connection upon attachment of the hearing aid to the user and by automatically breaking the electrical connection when the hearing aid is detached from the user, said switching means including a switch responsive to a change of temperature and being arranged on the hearing aid at a location which is subjected to the change of temperature, said switch being a temperature-sensitive switch in heat-conducting connection with the skin of the user at said location when the hearing aid is mounted to the user.

2. A hearing aid as defined in claim 1, and further comprising a housing having a wall surface facing the head of the user, said temperature-sensitive switch being arranged at said wall surface.

3. A hearing aid as defined in claim 2 wherein said wall surface has an area surrounding said temperature-sensitive switch and being made of heat conducting material.

4. A hearing aid as defined in claim 3 wherein said area is defined by a thin metal plate.

5. A hearing aid as defined in claim 1, and further comprising an ear insert for accommodating said amplifying means, said power source and said switching means, said location being defined by a wall surface which is part of said ear insert.

6. A hearing aid as defined in claim 1, and further comprising adjusting means operatively connected to said temperature-sensitive switch for adjusting the response temperature of said temperature-sensitive switch.

7. A hearing aid as defined in claim 1 wherein said temperature-sensitive switch is responsive within a temperature range between a lower limit and an upper limit.

8. A hearing aid as defined in claim 7 wherein said lower limit of said temperature range is 30°–35° C. and said upper limit thereof is 41° C.

9. A hearing aid as defined in claim 7, and further comprising optical indicating means operatively connected to said temperature-sensitive switch for providing an optical signal when the temperature is within said temperature range.

10. A hearing aid as defined in claim 9 wherein said optical indicating means is a reversible temperature color indicator.

11. A hearing aid; comprising:

amplifying means including an amplifier for boosting an incoming signal;

a power source operatively electrically connected to said amplifier; and switching means for automatically controlling the electrical connection between said amplifier and said power source by automatically providing the electrical connection upon attachment of the hearing aid to the user and by automatically breaking the electrical connection when the hearing aid is detached from the user, said switching means including a switch responsive to a change of state and being arranged on the hearing aid at a location which is subjected to the change of state wherein said switch includes a biosensor which is responsive to the change of state when inserting the hearing aid in the auditory meatus of the user.

12. A hearing aid; comprising:

amplifying means including an amplifier for boosting an incoming signal;

a power source operatively electrically connected to said amplifier; and switching means including a switch which is responsive to a change of state which occurs without direct actuation and without direct contact of the switch, said switch being arranged on the hearing aid at a location which is subjected to the change of state wherein said change of state causes said switching means to automatically control the electrical connection between said amplifier and said power source by automatically providing the connection upon attachment of the hearing aid to the user and by automatically breaking the connection when the hearing aid is detached from the user, wherein the electrical connection is maintained, indepedent of the position of the user, whenever the hearing aid is mounted to the user.

13. A hearing aid as defined in claim 12 wherein said switch is a light-sensitive switch, and further comprising an ear insert for accommodating said amplifying means, said power source and said switching means, said light-sensitive switch being disposed during use of the hearing aid within the auditory meatus of the user and breaking the electrical connection between said amplifier and said power source when detaching the hearing aid from the user.

14. A hearing aid as defined in claim 12, and further comprising a manually actuatable switch connected in series with said switch responsive to the change of state for at least making a connection between said amplifier and said power source.

15. A hearing aid as defined in claim 12, and further comprising a microphone connected to said amplifier and an earphone, said switch being responsive to a feedback signal which is generated by an acoustic feedback between said microphone and said earphone so that said switch in response to the occurrence of the acoustic feedback breaks the electrical connection between said amplifier and said power source and turns off the hearing aid after being detached from the user.

16. A hearing aid as defined in claim 15 wherein said feedback signal is a sound signal above a predetermined sound level, said switch being a control element responsive to said increased sound level.

17. A hearing aid as defined in claim 15 wherein said feedback signal is a sound signal at a certain frequency, said switch being a control element responsive to said frequency.

18. A hearing aid as defined in claim 15 wherein said feedback signal is a voltage signal which is generated in said amplifier by increased input sound pressure caused by the acoustic feedback.

19. A hearing aid as defined in claim 15, and further comprising a housing containing said amplifying means and said switching means and having at least one bore, and an ear insert having an outer shell enclosing said housing and being provided with at least one bore in alignment with said bore of said housing, said bore of said outer shell being closed by the auditory meatus when attaching the hearing aid to the user and generating with said bore of said housing during detachment of the hearing aid from the user an airborne sound bridge between said microphone and said earphone, with said airborne sound bridge representing said feedback signal and causing said switch to break the electrical connection between said amplifier and said power source.

20. A hearing aid as defined in claim 12 wherein said switch includes a motion indicator which breaks the electrical connection between said amplifier and said power source when said switch is in a stationary state for a predetermined period.

21. A hearing aid as defined in claim 20, and further comprising delay means operatively connected to said motion indicator for providing a delay time before said motion indicator turns off the hearing aid while allowing the hearing to be turned on immediately upon occurrence of motion.

22. A hearing aid as defined in claim 12 wherein said switch breaks the connection between said amplifier and said power source when registering an oxygen partial pressure which corresponds to the oxygen partial pressure of the atmosphere and makes the connection when the oxygen partial pressure deviates from the oxygen partial pressure of the atmosphere.

23. A hearing aid as defined in claim 12 wherein said switch includes a time element for delaying the response of said switch to the change of state for a predetermined period.

24. A hearing aid; comprising:

amplifying means including an amplifier for boosting an incoming signal;

a power source operatively electrically connected to said amplifier; and switching means including a switch which is responsive to a change of state which occurs without actuation of the switch through mechanical means, said switch being arranged on the hearing aid at a location which is subjected to the change of state wherein said change of state causes said switching means to automatically control the electrical connection between said amplifier and said power source by automatically providing the connection upon attachment of the hearing aid to the user and by automatically breaking the connection when the hearing aid is detached from the user, wherein the electrical connection is maintained, indepedent of the position of the user, whenever the hearing aid is mounted to the user.

* * * * *